US010404006B2

(12) United States Patent
Kawahara

(10) Patent No.: US 10,404,006 B2
(45) Date of Patent: Sep. 3, 2019

(54) PLUG SIDE CONNECTOR ASSEMBLY, DEVICE SIDE CONNECTOR AND CONNECTOR PAIR

(71) Applicant: NIPPON TANSHI CO., LTD., Kanagawa (JP)

(72) Inventor: Yuzo Kawahara, Kanagawa (JP)

(73) Assignee: NIPPON TANSHI CO., LTD., Kanagawa (JP)

( * ) Notice: Subject to any disclaimer, the term of this patent is extended or adjusted under 35 U.S.C. 154(b) by 0 days.

(21) Appl. No.: 16/303,737

(22) PCT Filed: May 15, 2017

(86) PCT No.: PCT/JP2017/018196
§ 371 (c)(1),
(2) Date: Nov. 21, 2018

(87) PCT Pub. No.: WO2017/204017
PCT Pub. Date: Nov. 30, 2017

(65) Prior Publication Data

US 2019/0207343 A1 Jul. 4, 2019

(30) Foreign Application Priority Data

May 24, 2016 (JP) ..... 2016-103548

(51) Int. Cl.
*H01R 13/514* (2006.01)

(52) U.S. Cl.
CPC ..... *H01R 13/514* (2013.01)

(58) Field of Classification Search
CPC ..... H01R 13/514; H01R 13/502
See application file for complete search history.

(56) References Cited

U.S. PATENT DOCUMENTS 6,332,813 B1 * 12/2001 Okabe ..... H01R 13/514 439/541.5
2002/0173198 A1 11/2002 Plate
2011/0104932 A1 * 5/2011 Koellmann ..... H01R 31/06 439/374

FOREIGN PATENT DOCUMENTS

| | | |
|---|---|---|
| JP | H05065078 | 8/1993 |
| JP | H10106670 | 4/1998 |
| JP | 2005322487 | 11/2005 |
| JP | 2008293950 | 12/2008 |
| JP | 2009043661 | 2/2009 |
| JP | 2010123274 | 6/2010 |

(Continued)

OTHER PUBLICATIONS

International Search Report for PCT/JP2017/018196 dated Jul. 25, 2017, 4 pages.

*Primary Examiner* — Abdullah A Riyami
*Assistant Examiner* — Nader J Alhawamdeh
(74) *Attorney, Agent, or Firm* — Dority & Manning, P.A.

(57) ABSTRACT

A plurality of plug side connectors that can be joined to and separated from one another are prevented from being combined incorrectly. An arrangement is made such that only when a particular combination of two of the plug side connectors are adjacent to each other, the groove of one of the two plug side housings slidably engages with the linear protrusion of the other plug side housing, or the linear protrusion of one of the two plug side housings slidably engages with the groove of the other plug side housing.

10 Claims, 11 Drawing Sheets

(56) References Cited

FOREIGN PATENT DOCUMENTS

| | | |
|---|---|---|
| JP | 2010146930 | 7/2010 |
| JP | 2014078370 | 5/2014 |

* cited by examiner

PLUG SIDE CONNECTOR ASSEMBLY, DEVICE SIDE CONNECTOR AND CONNECTOR PAIR

CROSS REFERENCE TO RELATED APPLICATIONS

This application is the U.S. National Stage entry of international. Application Number PCT/JP2017/018196 filed under the Patent Cooperation Treaty having a filing date of May 15, 2017, which claims priority to Japanese Patent Application No. 2016-403548 having a filing date of May 24, 2016, which are incorporated herein by reference.

TECHNICAL FIELD

The present invention relates to a plug side connector assembly, a device side connector and a connector pair, and in particular to a plug side connector assembly, a device side connector and a connector pair (connector structure) for a multi-pole connector.

BACKGROUND ART

It is known to form a multi-pole connector by forming an assembly of a plurality of plug side connectors that can be joined to and separated from one another. (See Patent Documents 1 and 2, for example.)

PRIOR ART DOCUMENT(S)

Patent Document(s)

Patent Document 1: JP2005-322487A
Patent Document 2: JP2014-78370A

SUMMARY OF THE INVENTION

Task to be Accomplished by the Invention

Conventional plug side connectors that can be joined to and separated from one another can be freely combined without any restriction, and are not provided with any means for preventing the plug side connectors from being combined incorrectly. It is therefore possible for the plug side connectors to be combined incorrectly so that incorrectly combined assembly of plug side connectors could be connected to a device side connector.

A primary object of the present invention is to prevent a plurality of plug side connectors that can be joined to and separated from one another from being combined incorrectly.

Means for Accomplishing the Task

To achieve such an object, the present invention provides a plug side connector assembly forming a multi-pole connector by combining a plurality of plug side connectors (10) that can be joined to and separated from one another, wherein each plug side connector (10) includes a plug side housing (12) having a substantially rectangular parallelepiped shape and having a pair of side faces (12A, 12B) that can each oppose an adjacent plug side connector (10), each plug side connector receiving a plug side terminal (18) therein, and wherein the plug side housing (12) is provided with at least one groove (24) on one of the side faces (12A, 12B) thereof, and at least one linear protrusion (26) on the other side face (12A, 12B) thereof in such a manner that only when a particular combination of two of the plug side connectors (10) are adjacent to each other, the groove (24) of one of the two plug side housings (12) slidably engages with the linear protrusion (26) of the other plug side housing (12), or the linear protrusion (26) of one of the two plug side housings (12) slidably engages with the groove (24) of the other plug side housing (12).

In this arrangement, since the plug side housings (12) are joined to each other only when particular two of the plug side connectors (10) are adjacent to each other, the two plug side connectors (10) that can be joined to and separated from each other are prevented from being combined with each other incorrectly.

In this plug side connector assembly, preferably, a plurality of pairs of the groove (24) and the linear protrusion (26) engaging each other between the adjacent two plug side housings (12) are provided, and the grooves (24) and the linear protrusions (26) are located at selected positions on the corresponding side faces (12A, 12B) with respect to a direction orthogonal to a sliding direction along which each linear protrusion slides with respect to the corresponding groove so that only such two of the plug side housings (12) that form joints at same positions with respect to the direction orthogonal to the sliding direction can be joined to each other.

Thus, only the two plug side housings (12) that can form the joints with the grooves (24) and the linear protrusions (26) located at the same positions can be joined to each other. Therefore, only the particular combinations of the two plug side housings (12) allow the two plug side housings to be joined to each other so that the two plug side connectors (10) that can be joined to and separated from each other are prevented from being combined with each other incorrectly.

Preferably, in this plug side connector assembly, each groove (24) is configured to be engaged by the corresponding linear protrusion (26) by a dovetail joint so that the adjacent plug side housings (12) are inseparably joined to each other in a lateral direction orthogonal to the side faces of the plug side housings.

The assembly of the plug side housings (12) in which the plug side housings (12) are inseparably joined to one another with respect the lateral direction can be formed before the assembly is connected to the device side connector (50), the plug side housings (12) formed in such an assembly can be jointly inserted into the device side housing (52) of the device side connector (50).

Preferably, in this plug side connector assembly, each groove (24) is configured to form a dovetail joint with the corresponding linear protrusion (26), and each side face (12A, 12B) is provided with a positioning groove (28) extending from at least one end of the groove (24) in a same direction as the groove (24) and configured to be engaged by the corresponding linear protrusion (26) in the lateral direction or a positioning protrusion (30) extending from at least one end of the linear protrusion (26) in a same direction as the linear protrusion (26) and configured to be engaged by the corresponding groove (24) in the lateral direction.

Thus, the dovetail joint between the groove (24) and the linear protrusion (26) can be established in two steps. First, a provisional positioning is performed by engaging the positioning groove (28) with the corresponding linear protrusion (26) or the positioning protrusion (30) with the corresponding groove (24) in the lateral direction, and, then, the plug side housings (12) are moved relative to each other in the extending direction of the groove (24) and the linear protrusion (26) until a dovetail joint is established between the groove (24) and the linear protrusion (26). Thus, the dovetail jointing work is facilitated.

Preferably, in this plug side connector assembly, the plug side housings (12) are each provided with a through hole (20) extending orthogonally to the side faces thereof, and the plug side connector assembly further comprises a connecting rod (23) passed into the through holes (20) of the plug side housings (12) to join the plug side housings (12) in a mutually aligned relationship.

Thereby, the assembly of the laterally aligned plug side housings (12) can be retained in the joined state additionally by the connecting rod (23).

Preferably, in this plug side connector assembly, the plug side terminals (18) each consist of a female terminal (18) received in a terminal receiving hole (14) defined in the corresponding plug side housing (12), and the female terminal (18) is provided with an engagement portion (18C) configured to be engaged by the connecting rod (23) when the female terminal is inserted in a prescribed insertion position in the terminal receiving hole (14) so that the connecting rod (23) serves as a retainer for retaining the female terminal (18) in the prescribed insertion position.

Thereby, all of the female terminals (18) in the assembly of the plug side housings (12) that are aligned in the lateral direction can be retained at the respective prescribed insertion positions by the single connecting rod (23) so that the number of component parts can be reduced.

Preferably, in this plug side connector assembly, each plug side housing (12) is provided with an engagement portion (32) configured to be detachably engaged by an engagement portion (60) provided on a device side housing (52) of a device side connector (50) to prevent the plug side housing (12) from being pulled out of the device side housing (52), an operation portion (40) for disengaging the engagement portion (32) of the plug side housing from the engagement portion (60) of the device side housing, and a connecting portion (72, 74) for detachably connecting the operation portion (40) with the operation portion (40) of the adjacent plug side housing.

The connecting portion (72, 74) allows the operation portions of the plug side housings to be joined to each other so that the unlocking of the engagement between the engagement portions (32) of the plug side housings (12) and the engagement portions (60) of the device side housing (52) can be performed jointly.

Preferably, in this plug side connector assembly, the plug side housings (12) are colored differently depending on kinds of the plug side housings.

Thereby, the kinds of the plug side housings (12) can be distinguished by the colors of the plug side housings (12).

A certain aspect of the present invention provides a device side connector, comprising a device side housing (52) defining a connector insertion chamber (54) configured to detachably receive all of the plug side housings (12) forming the assembly according to the aforementioned invention, and device side terminals (66) configured to be electrically connected to the corresponding plug side terminals (18) when the plug side housings (12) are inserted into the connector insertion chamber (54).

Thereby, all of the plug side connectors (12) forming the assembly can be collectively connected to the device side connector.

Preferably, this device side connector comprises a device side housing (52) defining a connector insertion chamber (54) configured to detachably receive all of the plug side housings (12) forming the assembly according to the aforementioned invention, and device side terminals (66) configured to be electrically connected to the corresponding plug side terminals (18) when the plug side housings (12) are inserted into the connector insertion chamber (54), the device side housing being provided at positions thereof where the plug side housings of respective kinds are to be inserted with colored parts (68) colored in the same colors as the respective plug side housings (12) which are to be inserted in these positions.

Thereby, by matching the colors of the plug side housings (12) with the colors put on the corresponding parts of the device side housing (52), the plug side connectors (10) are prevented from being incorrectly connected to the device side connector (50).

Preferably, in this device side connector, the device side housing (52) is provided with a plurality of guide portions (56, 58) configured to guide the corresponding plug side connectors (10) individually for each plug side housing (12) as the plug side connectors are inserted into and pulled out of the device side housing.

Thereby, even though there are no internal partition walls in the device side housing (52), the plug side terminals (18) and the device side terminals (66) can be connected to each other individually or for each plug side housing (12) so that the connection can be achieved with a relatively small insertion force compared to the case where the assembly of the plug side housings (12) is jointly inserted into the device side housing (52).

Another aspect of the present invention provides a connector pair comprising a plurality of plug side connectors (10) forming the assembly according to the aforementioned invention, and the device side connector (50) according to the aforementioned invention.

Thereby, a compact multi-pole connector incorporated with a foolproof mechanism for ensuring a correct arrangement of the plug side connectors (10) can be achieved by the assembly of the plug side connectors (10) that can be joined to and separated from one another and the single device side connector (50).

Effect of Invention

According to the assembly of plug side connectors of the present invention, the plug side connectors can be joined to each other only when a particular combination of the plug side connectors are adjacent to each other so that the plug side connectors that can be joined to and separated from each other are prevented from being incorrectly combined with each other.

BRIEF DESCRIPTION OF DRAWING(S)

DESCRIPTION OF THE PREFERRED EMBODIMENT(S)

Figure 1:
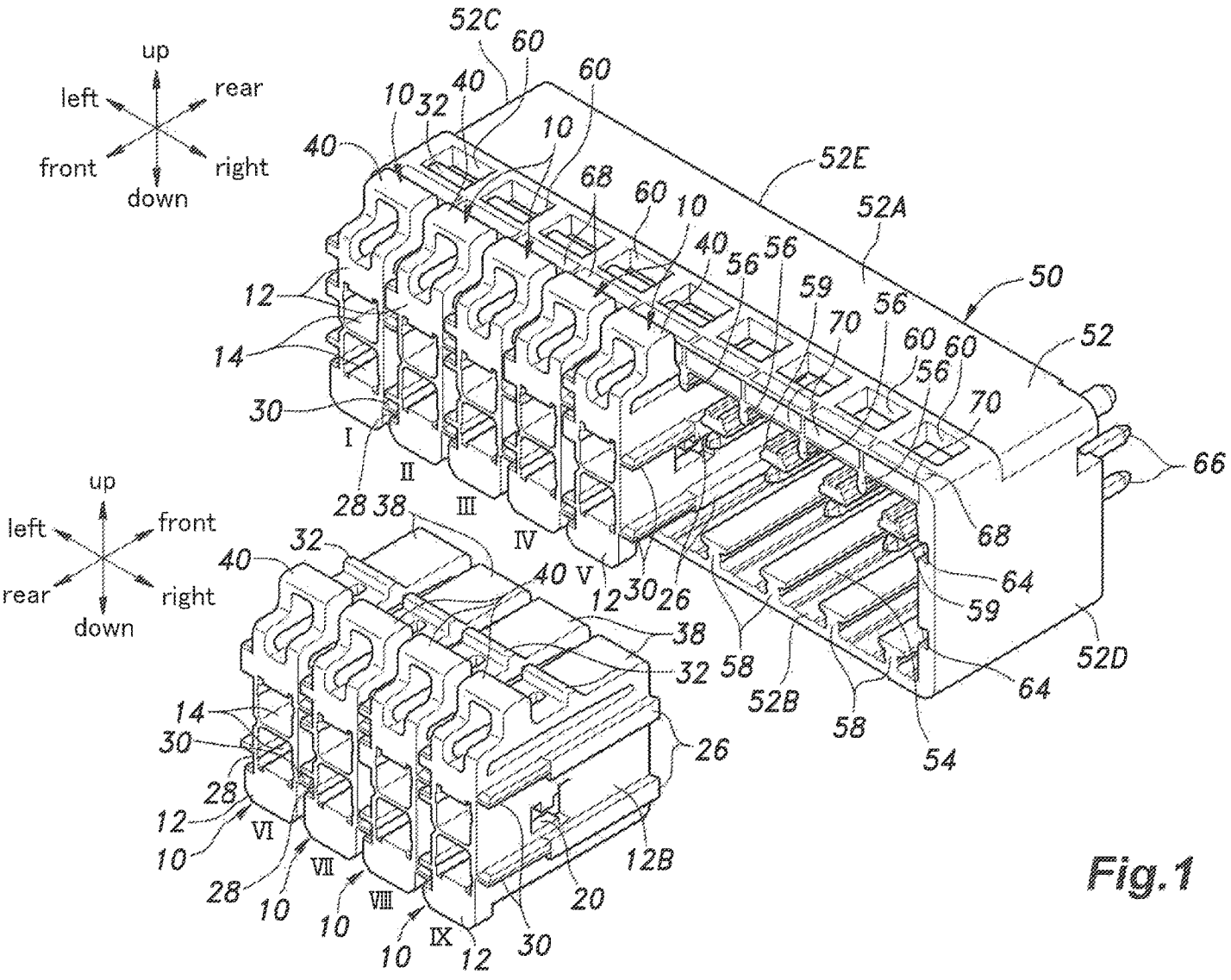
FIG. 1 is a perspective view of a plug side connector assembly, a device side connector and a connector pair according to an embodiment of the present invention.

A plug side connector assembly, a device side connector and a connector pair according to an embodiment of the present invention are described in the following with reference to FIGS. 1 to 8. In each of the drawings, directions such as front, rear, left, right, up and down are defined as indicated by the arrows. As shown in FIG. 1, the front and rear directions are reversed when referring to the plug side connector and the device side connector.

Figure 2:
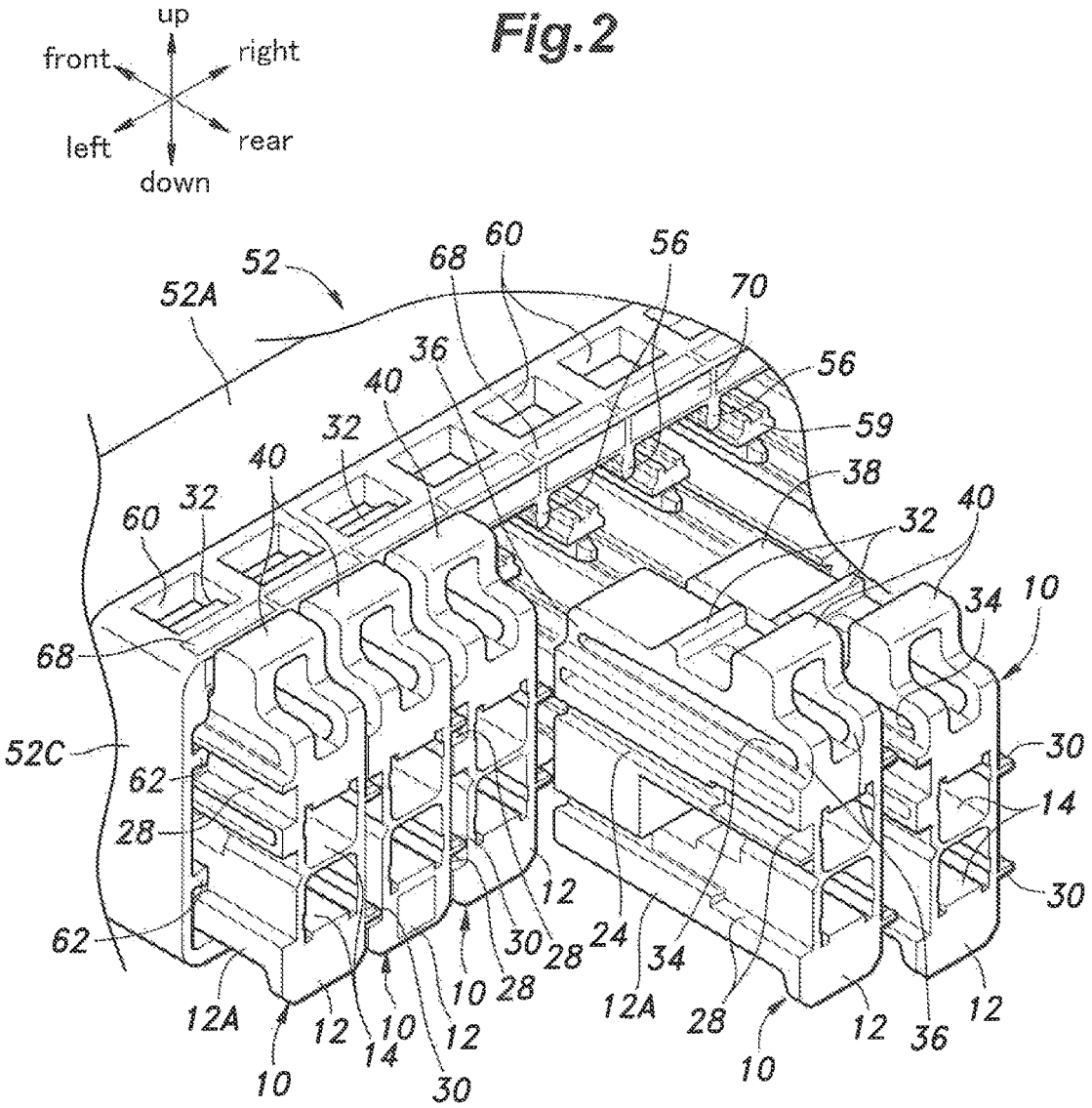
FIG. 2 is a fragmentary enlarged perspective view of the plug side connector assembly, the device side connector and the connector pair of this embodiment.

As shown in FIGS. 1 and 2, the connector pair (connector structure) includes an assembly of a plurality of plug side connectors 10 that can be joined to and separated from one another, and a device side connector 50 to which the plug side connectors 10 are to be connected.

Figure 3:
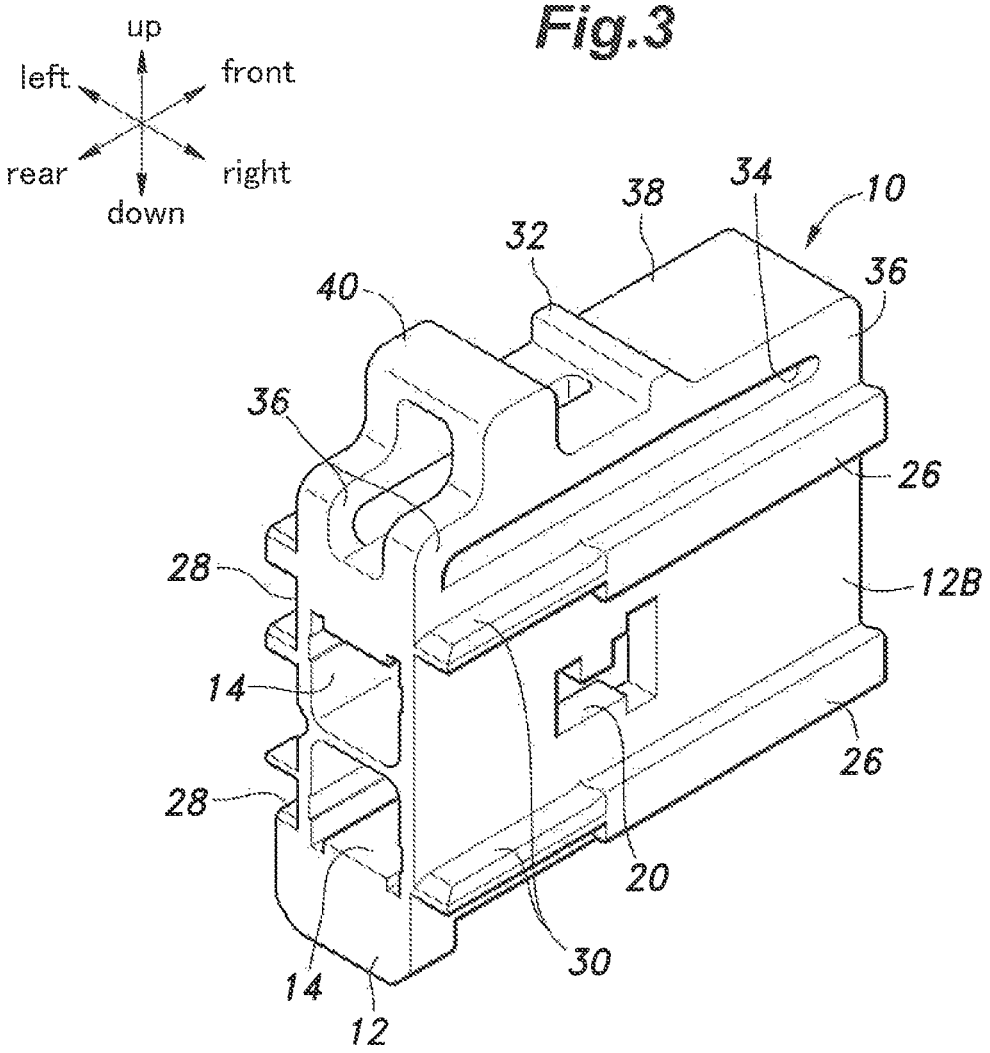
FIG. 3 is an enlarged perspective view of one of the plug side connectors of this embodiment.

As shown in FIGS. 1 to 3, each plug side connector 10 includes an individual plug side housing 12 made of a resin molded product. The plug side housing 12 has a substantially rectangular parallelepiped shape having a left side face 12A and a right side face 12B that are parallel to each other. The left side face 12A of each plug side housing 12 opposes the right side face 12B of the plug side connector 10 adjacent on the left side, and the right side face 12B of each plug side housing 12 opposes the left side face 12A of the plug side connector 10 adjacent to the right side, when the plug side connectors 10 are arranged in a left-right direction (lateral direction) in a mutually aligned relationship.

In this assembly of plug side connectors 10, the left side face 12A of the leftmost plug side housing 12 opposes the inner surface of a left end wall 52C of a device side connector 50 (which will be described hereinafter) and the right side face 12B of the rightmost plug side housing 12 opposes the inner surface of a right end wall 52D of the device side connector 50.

Figure 6:
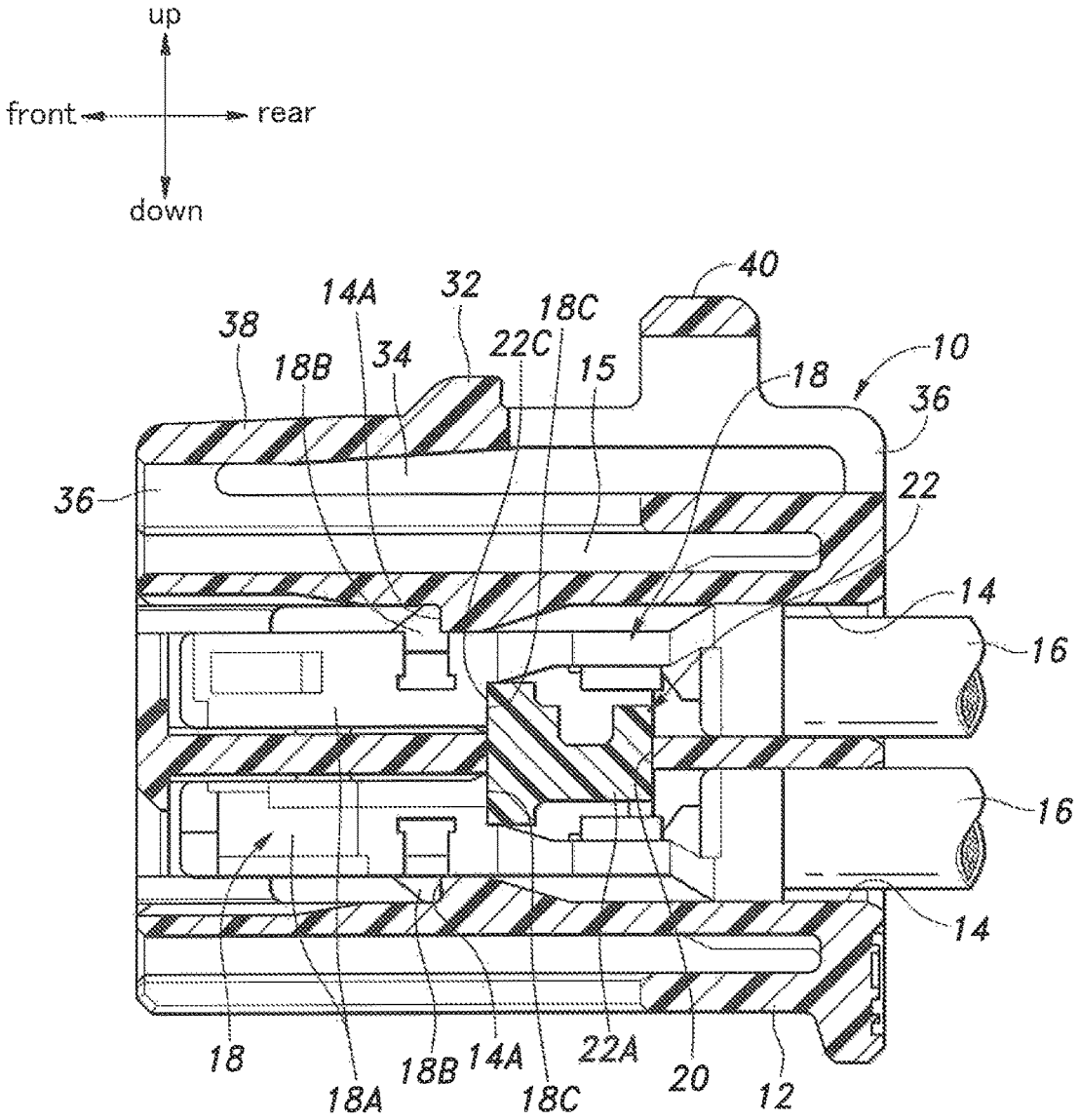
FIG. 6 is a vertical sectional view of the plug side connector of this embodiment.

Each plug side housing 12 is provided with a pair of terminal receiving holes 14 extending in the fore and aft direction one above the other. As shown in FIGS. 5 and 6, each terminal receiving hole 14 receives therein a metal female terminal (plug terminal) 18 having an insulated wire (cord) 16 electrically connected thereto. The female terminal 18 is provided with a cylindrical receptacle portion 18A configured to receive therein a projecting portion 66A of a male terminal 66 which will be described hereinafter, and a locking projection 18B consisting of a barb. The female terminal 18 is prevented from being pulled out from the plug side housing 12 owing to the locking projection 18B being engaged by a locking portion 14A formed on the plug side housing 12. The state in which the female terminal 18 is inserted in the terminal receiving hole 14 at a position where the locking projection 18B is engaged by the locking portion 14A is referred to as a state in which the female terminal 18 is fully inserted into the terminal receiving hole 14 or inserted into a prescribed position.

As shown in FIGS. 1, 3, 5, and 6, each plug side housing 12 is provided with a through hole 20 that penetrates the plug side housing 12 from the left side face 12A to the right side face 12B across parts of both the upper and lower terminal receiving holes 14 in the direction orthogonal to the right side face 12B (the left and right direction), and defines openings on the left side face 12A and the right side face 12B, respectively. In other words, the through hole 20 is located in a part located vertically between the upper and lower terminal receiving holes 14, and crosses a lower part of the upper side terminal receiving hole 14 and an upper part of the lower side terminal receiving hole 14 in the lateral direction.

As shown in FIG. 5, the plug side connector 10 includes a retainer 22 that is a separate member from the plug side housing 12. The retainer 22 is an L-shaped resin molded product, and is provided with a rod-like insertion portion 22A that is configured to be removably inserted into the through hole 20, and a grip 22B that is connected to one end of the insertion portion 22A and lies flat on the left side face 12A. The insertion portion 22A can be inserted into the through hole 20 after the female terminals 18 have been fully inserted in the respective terminal receiving holes 14 as indicated by (A), (B) and (C) of FIG. 5.

As shown in FIG. 6, only when the female terminals 18 are fully inserted into the terminal receiving holes 14 (to the prescribed position), the insertion portion 22A can be entirely inserted into the through hole 20 without colliding with the female terminals 18 in the terminal receiving holes 14. Once the insertion portion 22A is entirely received in the through hole 20, the grip 22B abuts onto the left side face 12A.

Therefore, when the female terminals 18 are not fully inserted into the terminal receiving holes 14 (to the prescribed position), the grip 22B remains spaced from the left side face 12A, and does not come into contact with the left side face 12A so that the worker can visually determine whether or not the female terminals 18 have been fully inserted into the terminal receiving holes 14 from the penetrating depth of the retainer 22 into the through hole 20. This allows the visual inspection to be easily carried out so as to avoid insertion failures of the female terminals 18.

Once the female terminals 18 are fully inserted in the terminal receiving holes 14, a front surface 22C of the insertion portion 22A, that has been inserted into the through hole 20, engages stepped surfaces (engagement portions) 18C of the female terminals 18 as shown in FIG. 6. As a result of this engagement also, the female terminals 18 are prevented from being pulled out of the plug side housing 12.

As shown in FIGS. 1 to 3, each plug side housing 12 is provided with a pair of grooves (key grooves) 24 extending in parallel to each other in the fore and aft direction at an upper and a lower position on the left side face 12A, and a pair of linear protrusions (keys) 26 are integrally formed at an upper and a lower two position of the right side face 12B so as to extend in parallel to each other in the fore and aft direction.

A mutually adjoining pair of plug side housings 12 can be joined to each other in a laterally aligned relationship owing to an engagement between the grooves 24 on the left side face 12A and the linear protrusions 26 on the right side face 12B which opposes the left side face 12A. The grooves 24 each consist of a "dovetail groove" having an inverted trapezoidal cross sectional shape with the open end of the groove corresponding to the short side, and the linear protrusions 26 are each provided with an inverted trapezoidal cross sectional shape with the tip end corresponding to the long side. Each groove 24 and the corresponding linear protrusion 26 can be dovetail fitted to each other.

In other words, the cross sectional shape of the groove 24 and the linear protrusion 26 includes a pair of overhangs on either side so that the linear protrusion 26 cannot be separated from the groove 24 in a direction (lateral direction) orthogonal to the left side face 12A and the right side face 12B.

The engagement between the groove 24 and the linear protrusion 26 that are to be dovetail jointed to each can be achieved by aligning the vertical positions of the two adjacent plug side housings 12 and displacing the two plug side housings 12 in the fore and aft direction (sliding movement) relative to each other, so that the two plug side housings 12, which are joined to each other via the dovetail joint, are secured to each other with respect to the lateral direction.

According to this arrangement, since the plug side connectors 10 are bundled together so as to be inseparable in the lateral direction even before the plug side connectors 10 are connected to the device side connector 50, the plug side connectors 10 which are secured to each other in advance in this manner can be connected to the device side connector 50 jointly or in one fell swoop.

Owing to this arrangement, the plug side connectors 10 can be connected to the device side connector 50 more quickly than is possible when the individual plug side connectors 10 are connected to the device side connector 50 one by one.

Figure 7:
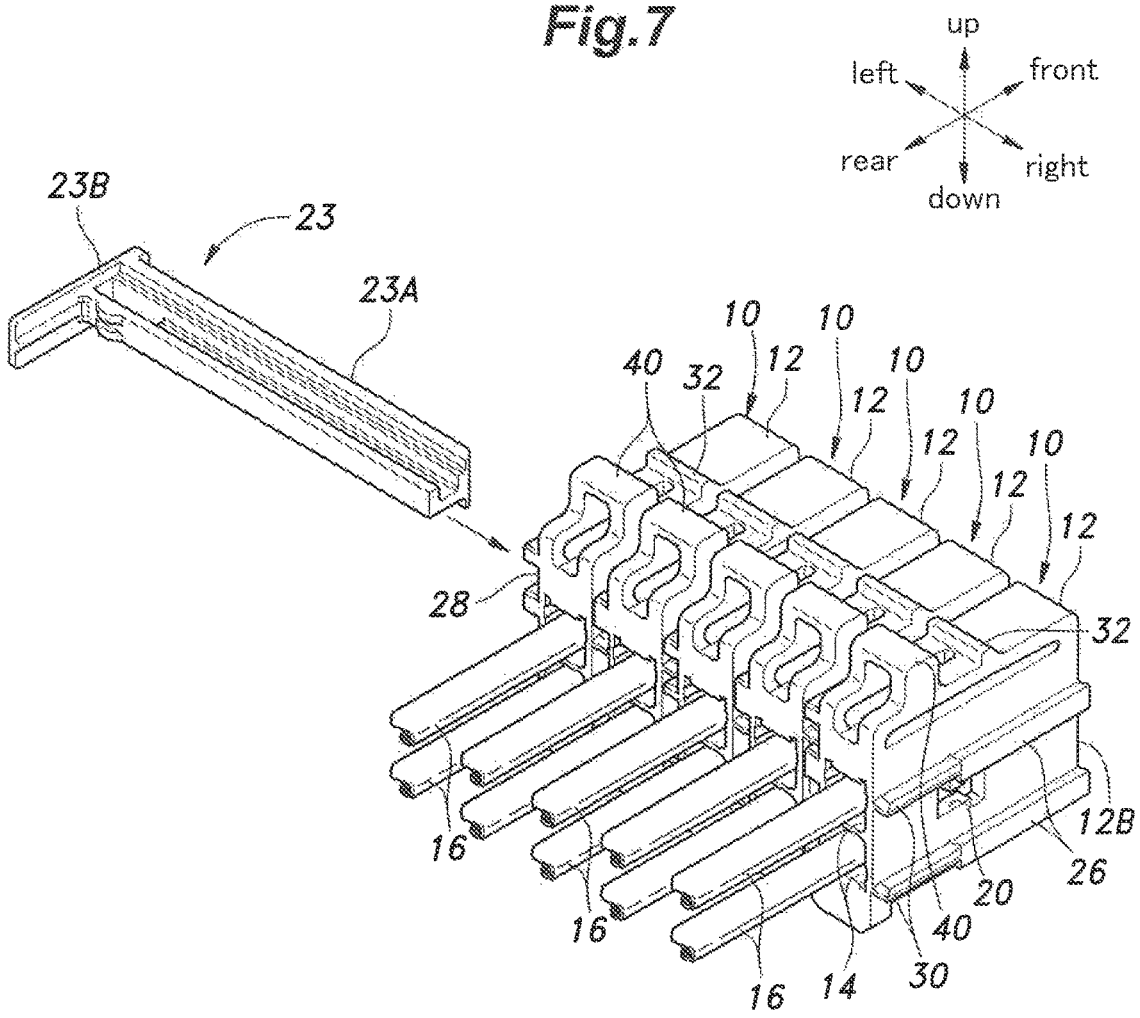
FIG. 7 is a perspective view illustrating a procedure for installing a retainer in the plug side connector assembly of this embodiment.

When the plug side connectors 10 are bundled together in this manner, the through holes 20 of the plug side housings 12 align straightly with one another in the lateral direction. In this case, as shown in FIG. 7, an L-shaped connecting rod 23 is used to hold the plug side connectors 10 together. The connecting rod 23 includes an insertion portion 23A having a length corresponding the combined lateral dimension of the plug side housings 12 and a grip 23B having a similar length as the grip 22B of the retainer 22.

By using the connecting rod 23 such that the insertion portion 23A is passed into the through holes 20 of the multiple plug side housings 12, the plug side housings 12 can be secured to one another with a high strength. Similarly as in the case of the insertion portion 22A of the retainer 22, the insertion portion 23A of the connecting rod 23 engages the female terminals 18 each at the prescribed position which was mentioned earlier so that the connecting rod 23 also serves the function of the retainer 22 by retaining the female terminals 18 each at the prescribed position all at once.

Therefore, only a single connecting rod (retainer) 23 is required for an assembly of multiple plug side connectors 10, instead of preparing a retainer 22 for each plug side connector 10 so that the number of component parts can be reduced.

As shown in FIGS. 1 to 3, the grooves 24 and the linear protrusions 26 do not extend over the entire length of the left side face 12A and the right side face 12B, respectively, in the fore and aft direction, but only in a front part of the left side face 12A and the right side face 12B, respectively, by a length smaller than the entire length of the plug side connector 10 (about ½ to ⅔ of the entire length).

As shown in FIG. 2, on the left side face 12A, positioning grooves 28 extend linearly rearward in continuation of the rear ends of the respective grooves 24. Each positioning groove 28 has a fore and aft length of about ½ to ⅓ of the total length of the left side face 12A in the fore and aft direction, and has a groove width greater than the maximum groove width of the groove 24 as measured in the vertical direction. Each positioning groove 28 is provided with a rectangular cross section, and has a width greater than the maximum width of the corresponding linear protrusion 26 so that the linear protrusion 26 can be received in the positioning groove 28 from sideways (in the lateral direction).

As shown in FIGS. 1 and 3, on the right side face 12B, positioning protrusions 30 are formed integrally so as to extend linearly rearward in continuation of the rear ends of the respective linear protrusions 26. Each positioning protrusion 30 is provided with a rectangular cross section, and has a width smaller than the minimum width of the linear protrusion 26, and smaller than the minimum width of the corresponding groove 24 so that the positioning protrusion 30 can be received in the groove 24 from sideways (in the lateral direction).

Before the two adjacent plug side housings 12 are received in a connector insertion chamber 54 of the device side housing 52 which will be described hereinafter or before the plug side connectors 10 are connected to the device side connector 50, the two adjacent plug side housings 12 can be joined to each other as described in the following. The two adjacent plug side housings 12 are brought laterally toward each other (such that the mutually opposing left side face 12A and the right side face 12B are brought closer to each other) with the two plug side housings 12 shifted from each other by a relative fore and aft distance of about ½ to ⅓ of the length of the plug side housings 12, and with the relative vertical position of the two plug side housings 12 aligned to each other within an error margin of the width of the positioning grooves 28 so as to provisionally locate the plug side housings 12 relative to each other with respect to the vertical direction. Thereafter, the two plug side housings 12 are moved in the fore and aft direction relative to each other from a state where the linear protrusions 26 are loosely fitted in the respective positioning grooves 28 to a state where the linear protrusions 26 are closely fitted in the respective grooves 24 each as a dovetail joint. Thereby, the dovetail jointing of the linear protrusions 26 with the respective grooves 24 is facilitated, and the work efficiency in bundling the plug side housings 12 before inserting them into the connector insertion chamber 54 of the device side housing 52 is improved.

Similarly, one more plug side housing 12 may be brought laterally toward one of the bundled plug side housings 12 (such that the mutually opposing left side face 12A and the right side face 12B are brought closer to each other) with the two plug side housings 12 shifted from each other by a relative fore and aft distance of about ½ to ⅓ of the length of the plug side housings 12, and with the relative vertical position of the two plug side housings 12 aligned to each other within an error margin of the width of the positioning grooves 28 as to provisionally locate the plug side housings 12 relative to each other with respect to the vertical direction. Thereafter, the two plug side housings 12 are moved in the fore and aft direction relative to each other from a state where the linear protrusions 26 are loosely fitted in the respective positioning grooves 28 to a state where the linear protrusions 26 are closely fitted in the respective grooves 24 each as a dovetail joint. Thereby, the dovetail jointing of the linear protrusions 26 with the respective grooves 24 is facilitated, and the work efficiency in bundling the plug side housings 12 before inserting them into the connector insertion chamber 54 of the device side housing 52 is improved.

Figure 4:
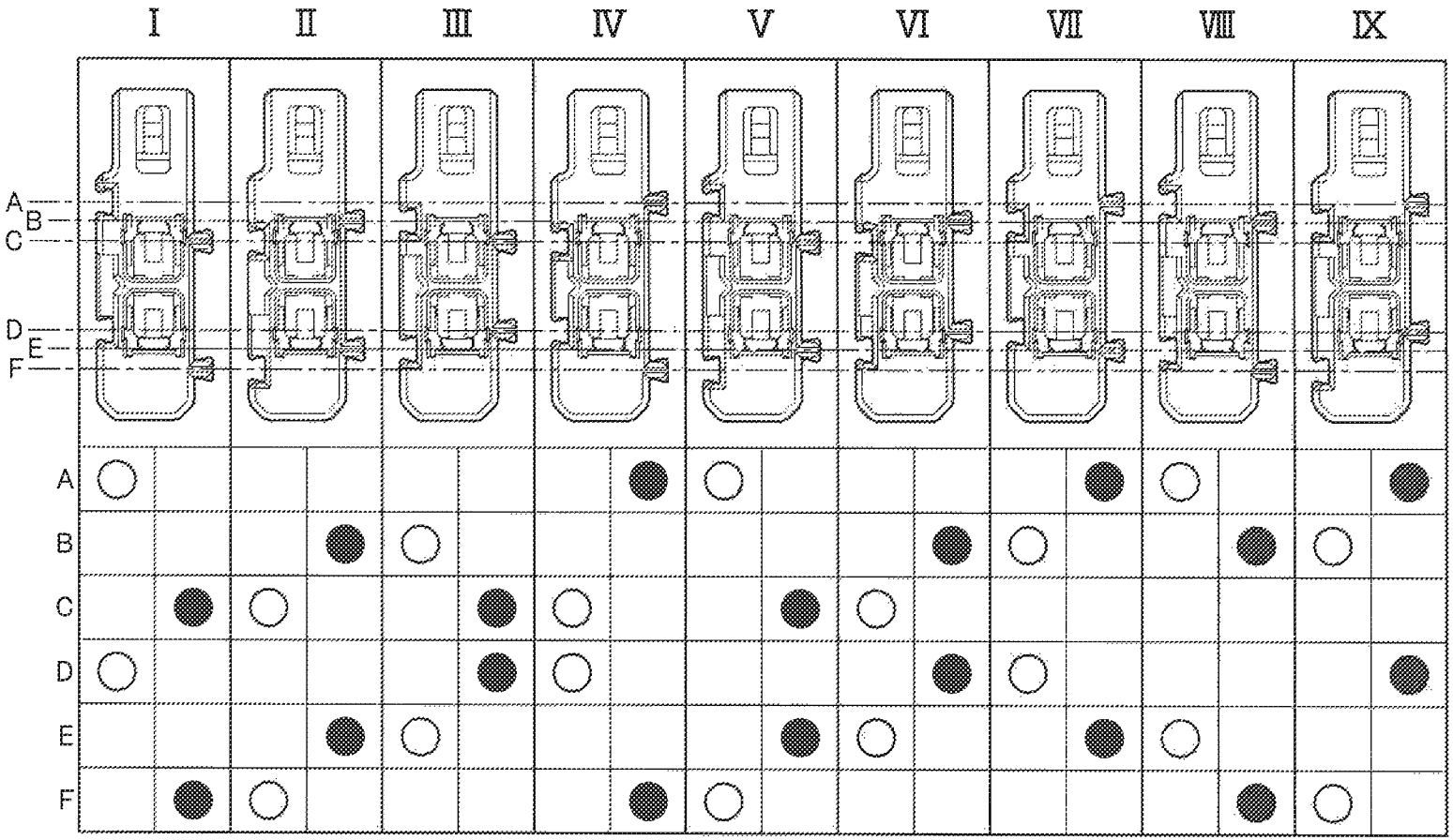
FIG. 4 is a diagram illustrating key arrangements in the plug side connectors of this embodiment.
Figure 5C:
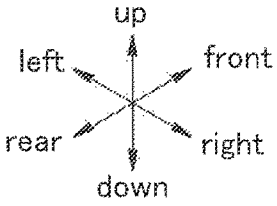
FIG. 5 is a perspective view illustrating a procedure for installing terminals and a retainer in the plug side connector of this embodiment.
Figure 5C:
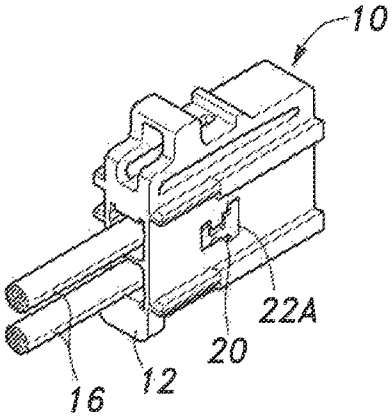
Figure 5B:
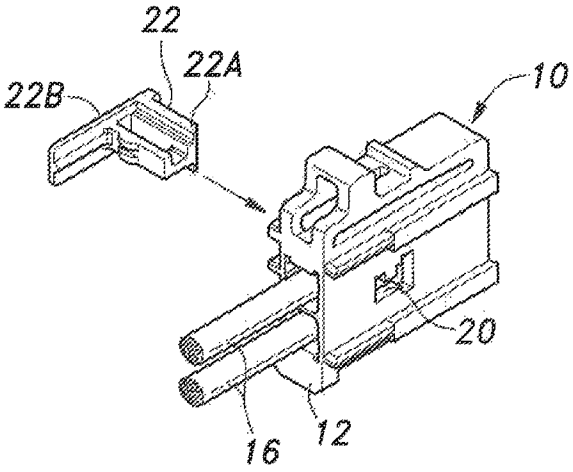
Figure 5A:
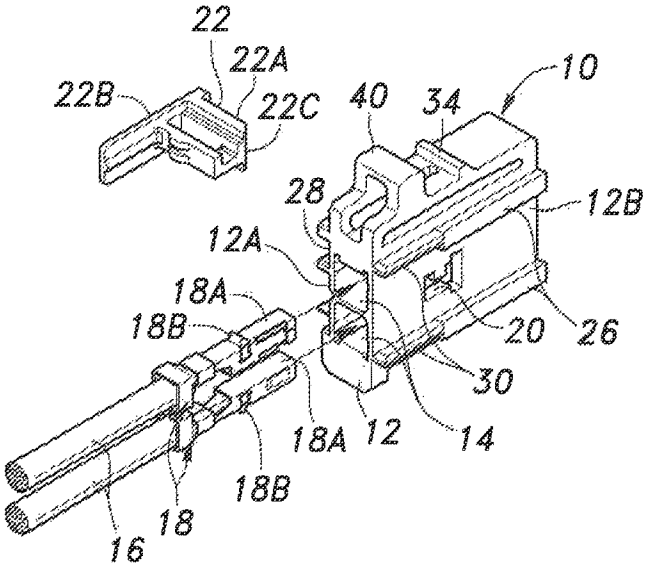

There are a plurality of joints between the grooves 24 and the linear protrusions 26 in the adjacent plug side housings 12. The vertical positions (or positions in a direction orthogonal to the sliding direction of the joints (fore and aft direction) of these joints may differ from one another. As shown in FIG. 4, six different vertical positions A to F can be assigned to each joint, and nine kinds (types I to IX) of plug side housings 12 having different joint positions are prepared. Only the particular combination of the two plug side housings 12 capable of forming two matching joints which are vertically spaced apart from each other can be bundled or joined to each other.

Thus, based on the agreement of the vertical positions of the grooves 24 and the linear protrusions 26, only particular combinations of plug side connectors 10 can be paired one next to the other in such a manner that the linear protrusions 26 of one of the plug side housings 12 are slidably engaged by the grooves 24 of the adjacent plug side housing 12 or the grooves 24 of one of the plug side housings 12 are slidably engaged by the linear protrusions 26 of the adjacent plug side housing 12. In FIG. 4, the white dots indicate the vertical positions of the grooves 24, and the black dots indicate the vertical positions of the linear protrusions 26.

For example, the plug side housing 12 of type I and the plug side housing 12 of type 11 can be joined to each other as one of the particular combinations because the upper groove 24 and the upper linear protrusion 26 are identically positioned at joint position C, and the lower groove 24 and the lower linear protrusion 26 are also identically positioned at joint position F. However, the plug side housing 12 of type III cannot be joined to the plug side housing 12 of type I as one of the particular combinations because the upper joint position thereof is at joint position B and the lower joint position thereof is at joint position E. Thus, an inappropriate bundling of the plug side housing 12 can be avoided owing to this foolproof arrangement.

Thus, according to this arrangement, nine plug side connectors 10 can be bundled together only when the plug side connectors 10 are arranged in the order of type I, type II, type III . . . Type VIII, and type IX. If this order is changed in any way, the plug side connectors 10 cannot be bundled together. For instance, the plug side connectors 10 of type I, type III and type II cannot be joined to one another if arranged in this order. Therefore, an inappropriate bundling of the plug side housing 12 can be avoided.

As shown in FIGS. 1 to 3 and 6, each plug side housing 12 is provided with an elastically deformable plate portion 38 made of plastic material, and formed as a beam having a front and a rear end that are integrally connected to a front and a rear end part of the plug side housing 12 via connecting portions 36, respectively, so that the elastically deformable plate portion 38 is connected to the plug side housing 12 solely at the front and rear ends thereof, and is spaced upward from an upper end of the plug side housing 12 by a gap 34. An intermediate part of the elastically deformable plate portion 38 is provided with an upwardly projecting engagement projection 32 which is configured to be detachably engaged by an engagement opening 60 which will be described hereinafter. The engagement projection 32 can be displaced vertically owing to a downwardly convex deformation of the elastically deformable plate portion 38.

An unlock operation portion 40 is formed on an upper side of a rear part of the elastically deformable plate portion 38. The unlock operation portion 40 is a knob that causes the elastically deformable plate portion 38 to undergo a downwardly convex deformation when depressed downward by a finger, and the engagement projection 32 to be disengaged from engagement opening 60.

The whole plug side housing 12 including the elastically deformable plate portion 38, the engagement projection 32, and the unlock operation portion 40 are colored differently according to the kinds thereof, or types I to IX. The coloring of the plug side housing 12 can be performed by adding a pigment of a designated color to the resin material at the time of molding the plug side housing 12.

The operator can easily distinguish the kind of the plug side connector 10 by the color of the plug side housing 12. Most preferably, the colors of the plug side housing 12 are set individually for types I to IX. However, the necessary number of colors may be reduced by setting those which are distant from each other to the same colors. For instance, type I and VI may be set to white, types II and VII to purple, types III and VIII to red, types IV and IX to green, and type V to blue.

Figure 8:
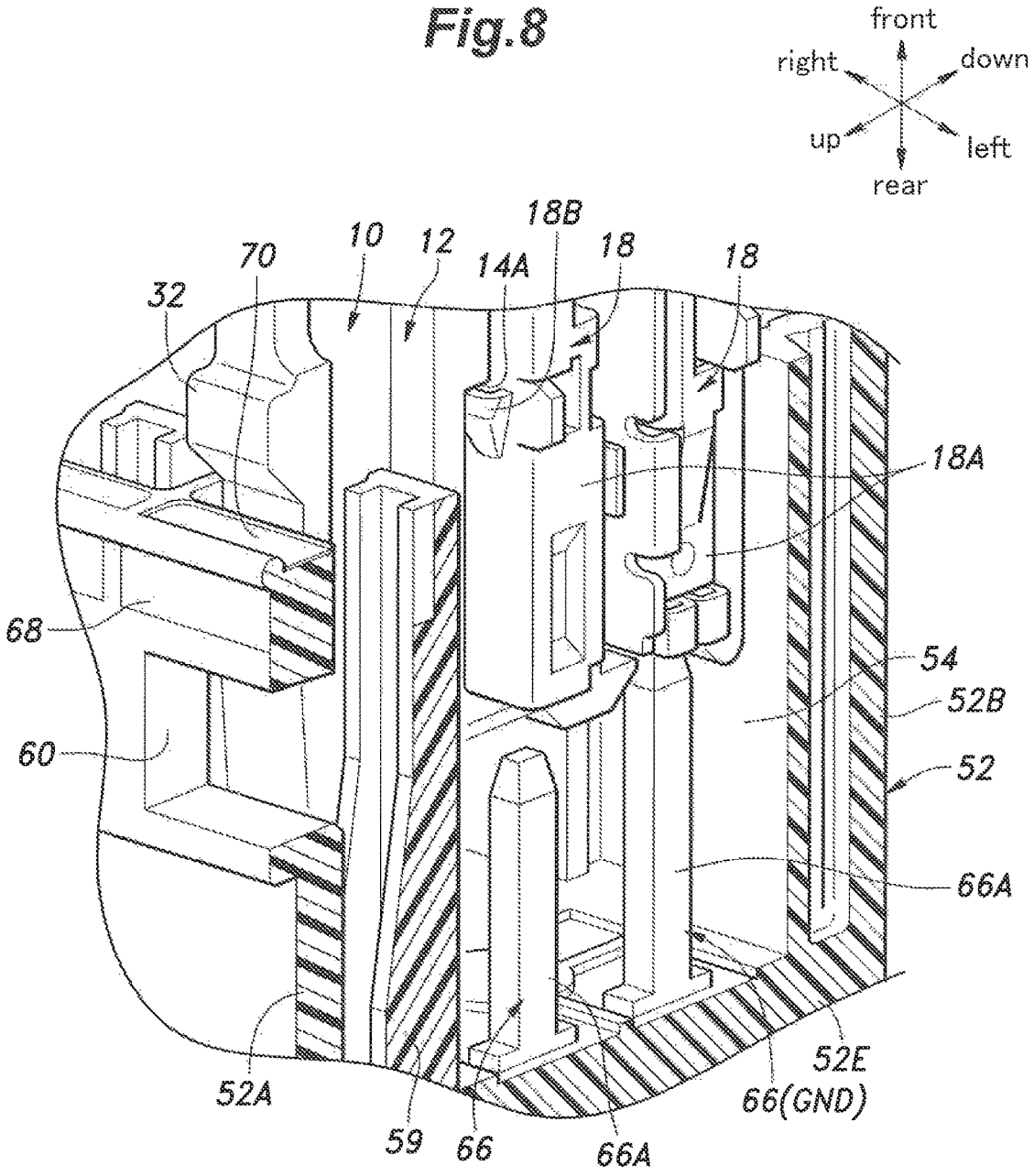
FIG. 8 is a fragmentary sectional perspective view of the device side connector of this embodiment.

As shown in FIGS. 1, 2 and 8, the device side connector 50 includes a device side housing 52 made of a resin molded member. The device side housing 52 has a rectangular parallelepiped shape having an open front end, and includes an upper wall 52A, a lower wall 52B, a left end wall 52C, a right end wall 52D, and a bottom (rear) wall 52E. The bottom wall 52E is fixedly attached to a circuit board (not shown in the drawings) or the like.

The upper wall 52A, the lower wall 52B, the left end wall 52C, the right end wall 52D, and the bottom wall 52E of the device side housing 52 define a single connector insertion chamber 54 which is open at the front end and having no partitions therein so as to accept a plurality of plug side connectors 10 forming an assembly in a detachable manner in the fore and aft direction. The connector insertion chamber 54 thus defines a single space that can accept the entire bundle of the plug side connectors 10 without being hampered by any partitions.

Therefore, the lateral dimension of the device side connector 50 configured to accept a prescribed number of plug side connectors 10 can be minimized, and the device side connector 50 can be made highly compact.

The device side housing 52 is integrally formed with upper guide rails 56 projecting from the upper wall 52A thereof facing the connector insertion chamber 54 and extending in the fore and aft direction at positions corresponding to the sides of the respective plug side housings 12. The upper guide rails 56 are configured to slidably engage the upper parts of the plug side housings 12 and the elastically deformable plate portion 38 while restricting the lateral movement and the vertical movement thereof. The device side housing 52 is also integrally formed with lower guide rails 58 projecting from the lower wall 52B thereof facing the connector insertion chamber 54 and extending in the fore and aft direction at positions corresponding to the sides of the respective plug side housings 12. The lower guide rails 58 are also configured to slidably engage the lower parts of the plug side housings 12 while restricting the lateral movement and the vertical movement thereof.

Thereby, the upper guide rails 56 and the lower guide rails 58 guide the plug side housings 12 individually for each plug side housing 12 or for each plug side connector 10 as the plug side housings 12 are inserted into and removed out of the device side housing 52 in the fore and aft direction, to thereby allow the plug side housings 12 to be inserted into the device side housing 52 one by one. As a result, the connection between the female terminals 18 and corresponding male terminals 66 (which will be described hereinafter) provided in the device side connector 50 can be performed individually for each plug side housing 12 even though no partition walls are provided in the device side housing 52 so that the connection can be achieved with a relatively small insertion force compared to the case where the assembly of the plug side housings 12 is jointly inserted into the device side housing 52.

In addition, since the upper guide rails 56 and the lower guide rails 58 individually retain the plug side housings 12 at predetermined relative positions in the lateral direction, even though the device side housing 52 is not provided with any internal partition walls, the multiple plugs side connectors 10 can be inserted into the device side connector 50 until the prescribed positions are reached even when the plugs side connectors 10 are not joined with one another continuously, but joined with one another with an omission in-between.

The device side housing 52 is further provided with a plurality of insertion guide portions 59 integrally protruding from the bottom wall 52E in the same direction as the insertion direction of the plug side housings 12. The insertion guide portions 59 are provided so as to correspond to the respective plug side housings 12, and are each configured to be inserted into an engagement portion 15 (see FIG. 6) of the corresponding plug side housing 12 so that the plug side housing 12 may be guided in the plugging and unplugging movement directed in the fore and aft direction while being positioned with respect to the lateral direction and the vertical direction jointly with the upper guide rails 56 and the lower guide rails 58.

A pair of linear protrusions 62 (see FIG. 2) are formed on the left end wall 52C so as to be slidably engaged by the respective grooves 24 of the plug side housing 12 disposed on the left side thereof in the fore and aft direction. A pair of grooves 64 (see FIG. 1) are formed on the right end wall 52D so as to slidably engage the respective linear protrusions 26 of the plug side housing 12 formed on the right side thereof. The linear protrusions 62 and the grooves 64 each have an inverted trapezoidal cross sectional shape similar to that of the linear protrusions 26 and the grooves 24.

The device side housing 52 is provided with engagement openings 60 in the upper wall 52A thereof, each engagement opening 60 being configured to engage the corresponding engagement projection 32. Once each plug side housing 12 fully inserted into the connector insertion chamber 54, and the engagement projection 32 is fitted into the engagement opening 60, the plug side housing 12 is locked in place or is prevented from coming off.

As shown in FIG. 8, the device side connector 50 is provided with male terminals (device side terminals) 66 at positions corresponding to the female terminals 18 of the plug side housings 12 inserted into the connector insertion chamber 54. The male terminals 66 are provided in the same number as the total number of the female terminals 18 in the plug side housings 12 that can be inserted into the connector insertion chamber 54, and extend from the bottom wall 52E in the same direction as the insertion direction of the plug side housings 12. Each male terminal 66 is provided with a projecting portion 66A protruding into the connector insertion chamber 54. The projecting portion 66A is fitted into the receptacle portion 18A of the corresponding female terminal 18 so that the female terminal 18 and the male terminal 66 are electrically connected to each other.

The male terminal 66 denoted with the letters (GND) in FIG. 8 is a grounding terminal. The projecting length of the projecting portion 66A of the grounding terminal 66 (GND) is longer than the projecting length of the projecting portions 66A of the other male terminals 66. Consequently, when the female terminals 18 and the male terminals 66 are connected to each other, the ground male terminal 66 (GND) comes into contact with the corresponding female terminal 18 before any other male terminals 66 so that the safety of the device connected to the device side connector 50 can be enhanced by eliminating static charges by grounding.

As shown in FIGS. 1 and 2, square colored regions 68 and 70 are provided on the front side of the upper wall 52A and the parts of the upper wall 52A corresponding to the upper edge of the front opening of the connector insertion chamber 54. The colored regions 68 and 70 are provided as a graphic symbol (square) printed by using an ink jet printer, for instance, so as to correspond to the colors set to the plug side connectors 10 that are adapted to be inserted into the particular positions indicated by the colored regions 68 and 70, and are aligned with the corresponding engagement openings 60. For instance, the colored regions 68 and 70 located in a lateral position corresponding to the plug side housing 12 are marked by red graphic symbols that are printed in red ink.

The plug side connectors 10 are connected to the device side connector 50 in such a manner that the upper and lower ends of each plug side housing 12 or the upper end and lower ends of a plurality of plug side housings 12 bundled together by the engagement between the grooves 24 and the linear protrusions 26 of the plug side housings 12 of the adjacent plug side connectors 10 are engaged and guided by the upper guide rails 56 and the lower guide rails 58 as the plug side connector 10 is or the plug side connectors 10 are slid and inserted into the connector insertion chamber 54. During this process, each engagement projection 32 slides under the front edge of the upper wall 52A while the elastically deformable plate portion 38 resiliently deflects downward, and is eventually engaged by the corresponding engagement opening 60, and held in place.

During this connecting process, color matching between the colors of the colored regions 68, 70 and the colors of the plug side housings 12 is performed so that the plug side connectors 10 are prevented from being incorrectly connected to the device side connector 50 in addition to the measure against incorrect connection using the different vertical positioning of the joints between the linear protrusions 26 and the grooves 24.

Removal of the plug side connectors 10 can be effected by pressing down the unlock operation portion 40 by a finger of a worker to lower the engagement projection 32 against the resilient force caused by the elastic deformation of the elastically deformable plate portion 38 until the engagement projection 32 is disengaged from the engagement opening 69, and pulling the thus unlocked plug side connectors 10 out of the device side housing 52 as a bundle. When a plurality of plug side connectors 10 are to be removed as a bundle, the unlock operation portions 40 of the plug side connectors 10 may be simultaneously pushed down.

Figure 9:
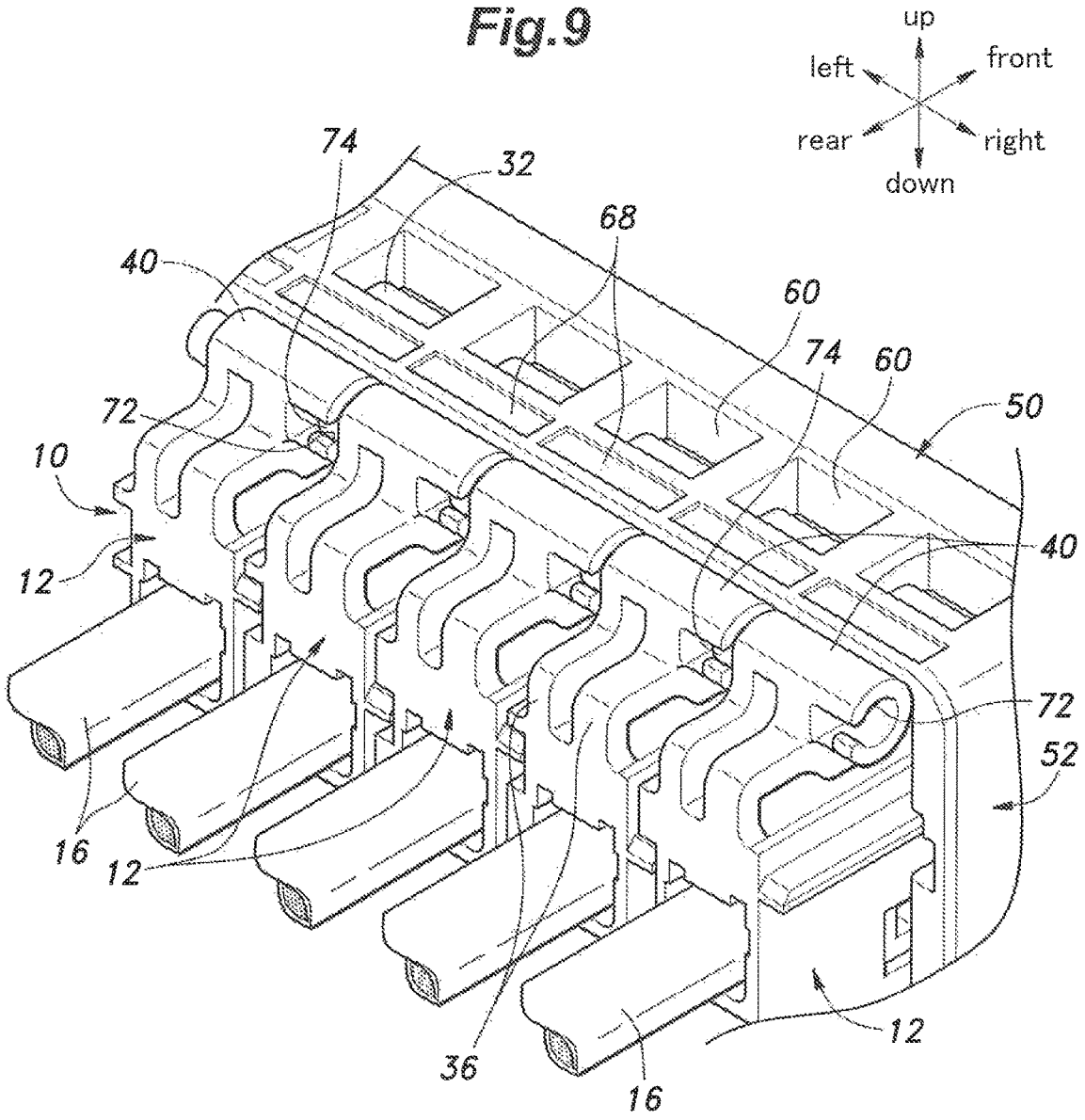
FIG. 9 is a perspective view of a plug side connector assembly, a device side connector and a connector pair according to another embodiment of the present invention.
Figure 10:
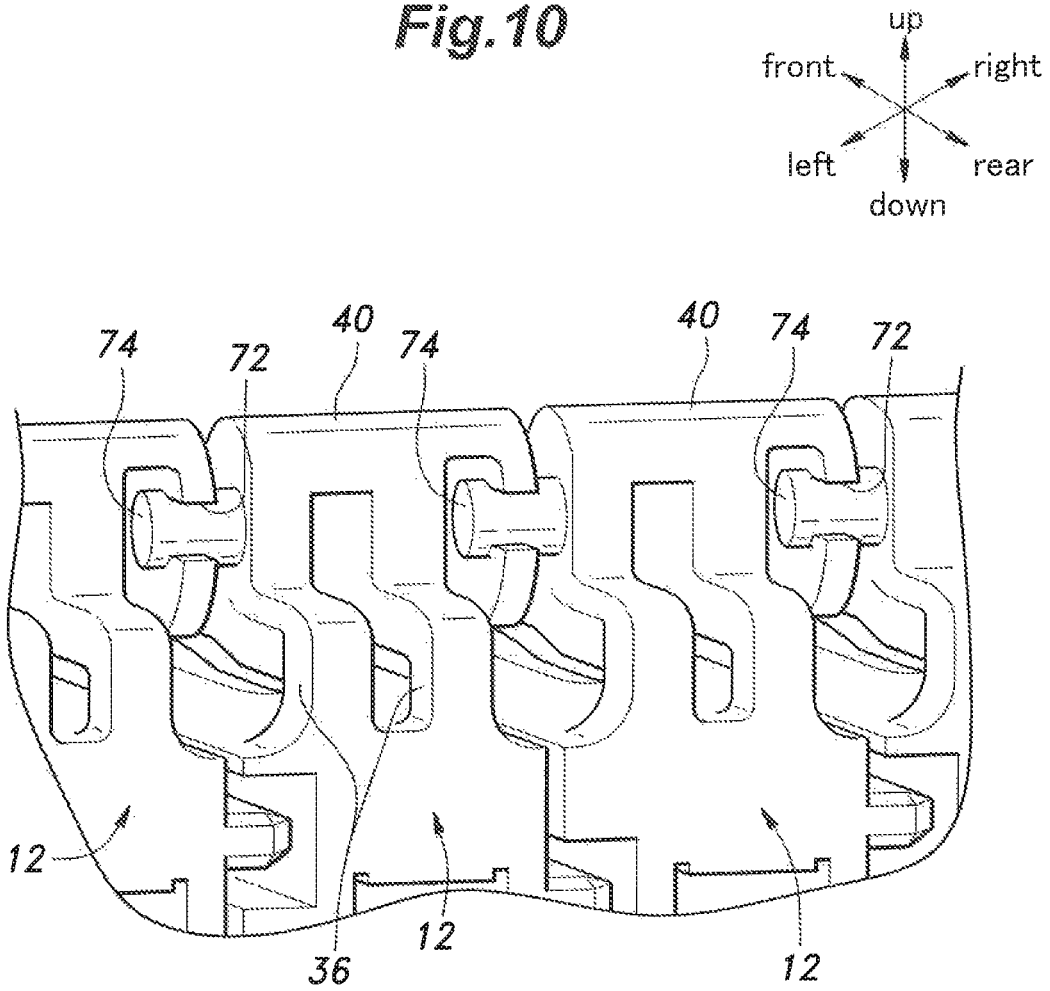
FIG. 10 is an enlarged perspective view of one of the plug side connectors of the other embodiment.

Next, a plug side connector assembly, a device side connector and connector pair according to another embodiment of the present invention are described in the following with reference to FIG. 9 and FIG. 10. In FIGS. 9 and 10, the parts corresponding to those in FIGS. 1 to 8 are denoted with like numerals, and such parts may be omitted in the following description.

In this embodiment, a recess 72 is formed in a right end part of each unlock operation portion 40, and a projection 74 is formed in a left end part of each unlock operation portion 40. The recess 72 has a C-shaped cross section having an opening facing rearward, and the projection 74 has a cylindrical shape so that as a pair of adjacent plug side housings 12 are displaced in the fore and aft direction relative to each other, or as a plug side housing 12 is pushed into the device side housing 52 next to another plug side housing 12 which is already received in the device side housing 52, the projection 74 of the unlock operation portion 40 of one of the plug side housings 12 is fitted into the recess 72 of the unlock operation portion 40 of the other plug side housing 12 so that the unlock operation portions 40 of the two adjacent plug side housings 12 are joined to each other.

In this embodiment, because the unlock operation portions 40 of the adjacent plug side housings 12 are joined to each other, simply by pressing the unlock operation portion 40 of one of the plug side housings 12, the adjacent plug side housings 12 are simultaneously unlocked by jointly disengaging the engagement projections 32 from the corresponding engagement openings 60. As a result, a plurality of adjacent plug side housings 12 can be jointly removed in a highly simple manner.

Although the present invention has been described in terms of specific embodiments thereof, as can be appreciated by a person skilled in the art, the present invention is not limited by such embodiments, but can be freely modified without departing from the spirit of the present invention.

Figure 11:
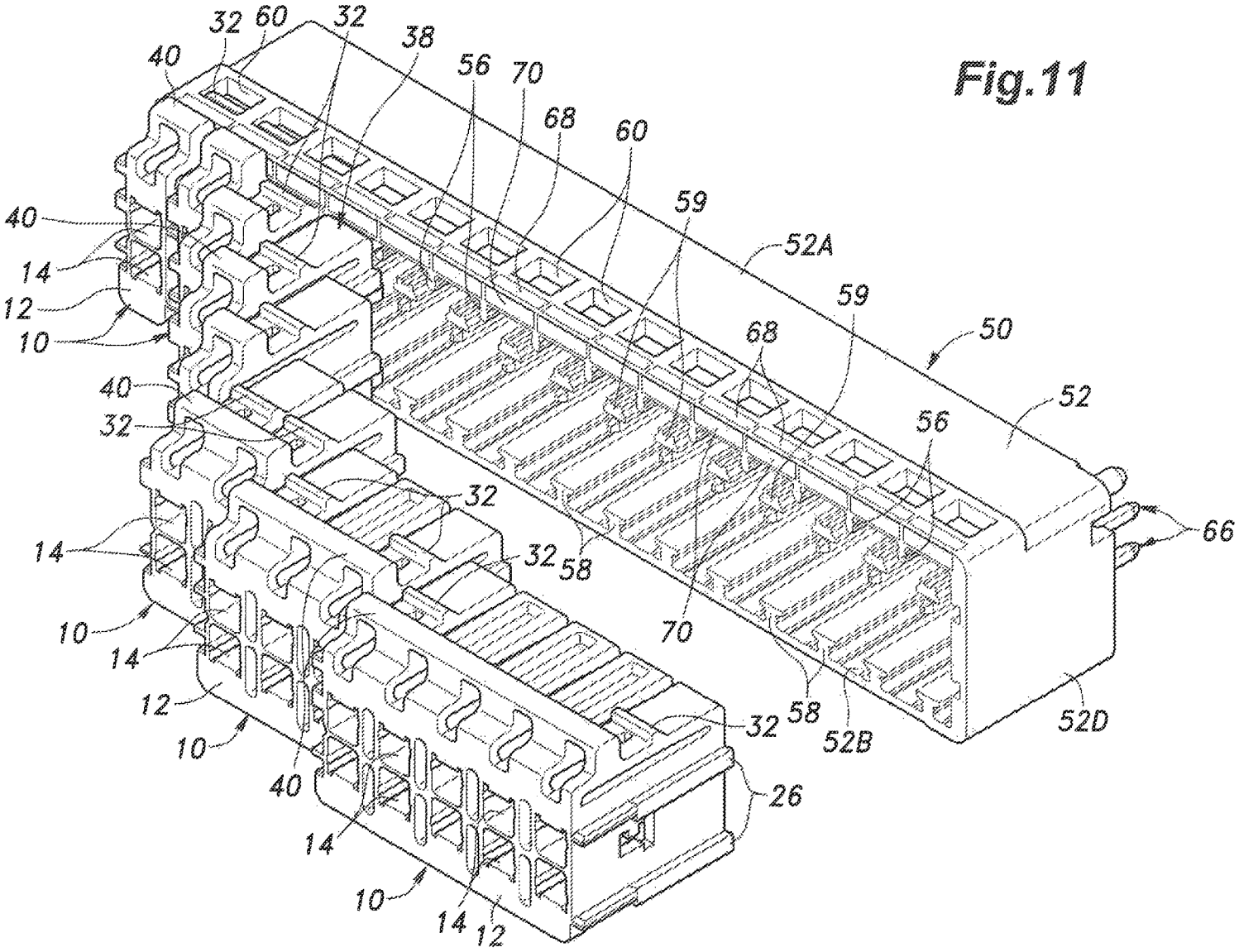
FIG. 11 is a perspective view of a plug side connector assembly, a device side connector and a connector pair according to yet another embodiment of the present invention.

For example, as shown in FIG. 11, the plug side connector 10 is not limited to a two-pole connector, but may be formed as a four-pole connector which integrally combines a pair of two-pole plug side housings 12, a six-pole connector which integrally combines three two-pole plug side housings 12, or a ten-pole connector which integrally combines five two-pole plug side housings 12.

When a plurality of two-pole plug side housings 12 are integrally molded together, the rear parts of the adjacent plug side housings 12 are integrally joined with one another other, and can be jointly inserted into the connector insertion chamber 54 like a single plug side housing 12 guided by the upper guide rails 56 and the lower guide rails 58. When three or more two-pole plug side connector housings 12 are integrally joined together, the engagement projections 32 may be provided only on the side connector housings 12 positioned on either end, and the unlock operation portion 40 may be provided only on one of the plug side connector housings 12.

The number of the types of the plug side housings 12 determined by the vertical positions of the grooves 24 and the linear protrusions 26 is not limited to nine, but may be less than nine or more than nine. The structure for allowing the adjacent plug side housings 12 to be joined to each other only in the cases of particular combinations of the two adjacent side connector housings 12 for the grooves 24 of one of the plug side housings 12 to be slidably engaged by the linear protrusions 26 of the other plug side housing 12, or for the linear protrusions 26 of one of the plug side housings 12 to be slidably engaged by the grooves 24 of the other plug side housing 12 is not limited to that based on the agreement of the vertical positions of the linear protrusions 26 and the grooves 24, but may also be based on the agreement of the shapes or sizes of the linear protrusions 26 and the grooves 24. It is also possible for each plug side connector 10 to be provided with a male terminal while the device side connector is provided with female terminals.

The linear protrusions 62 formed on the left end wall 52C of the device side housing 52 may be omitted, and the grooves 64 formed in the right end wall 52D may be each provided with a width large enough for the corresponding linear protrusion 26 to be received therein without regard to the vertical position (positions A to C, and/or positions D to F) of the linear protrusion 26. In such a case, the device side housing 52 can be used without regard to the kinds of the plug side connectors 10.

The groove 24 and the linear protrusion 26 that are configured to be dovetail jointed to each other may be provided with a cross sectional shape other than an inverted trapezoidal shape such as a hook-shape or the like.

The components included in the foregoing embodiments are not necessarily essential for the present invention, and can be omitted as required without departing from the spirit of the present invention.

GLOSSARY OF TERMS

10 plug side connector
12 plug side housing
12A left side face
12B right side face
14 terminal receiving hole
14A locking portion
15 engagement portion
16 insulated wire
18 female terminal (plug side terminal)
18A receptacle portion
18B locking projection
18C stepped surface
20 through hole
22 retainer
22A insertion portion
22B grip
22C front surface
23 connecting rod
23A insertion portion
23B grip
24 groove
26 linear protrusion
28 positioning groove
30 positioning protrusion
32 engagement projection
34 gap
36 connecting portion
38 elastically deformable plate portion
40 unlock operation portion
50 device side connector
52 device side housing
52A top wall
52B lower wall
52C left end wall
52D right end wall
52E bottom wall
54 connector insertion chamber
56 upper guide rail (guide portion)
58 lower guide rail (guide portion)
59 insertion guide portion
60 engagement opening
62 linear protrusion
62A protruding portion
64 groove
66 male terminal (device side terminal)
66A projecting portion
68 colored portion
70 colored portion
72 recess
74 projection

The invention claimed is:

1. A plug side connector assembly forming a multi-pole connector by combining a plurality of plug side connectors that can be joined to and separated from one another, wherein each plug side connector includes a plug side housing having a substantially rectangular parallelepiped shape and having a pair of side faces that can each oppose an adjacent plug side connector, each plug side connector receiving a plug side terminal therein, wherein the plug side housing is provided with at least one groove on one of the side faces thereof, and at least one linear protrusion on the other side face thereof in such a manner that only when a particular combination of two of the plug side connectors are adjacent to each other, the groove of one of the two plug side housings slidably engages with the linear protrusion of the other plug side housing, or the linear protrusion of one of the two plug side housings slidably engages with the groove of the other plug side housing, wherein the plug side housings are each provided with a through hole extending orthogonally to the side faces thereof, and the plug side connector assembly further comprise a connecting rod passed into the through holes of the plug side housings to join the plug side housings in a mutually aligned relationship, and wherein the pug side terminals each consist of a female terminal received in a terminal receiving hole defined in the corresponding plug side housing, and the female terminal is provided with an engagement portion configured to be engaged by the connecting rod when the female terminal is inserted in a prescribed insertion position in the terminal receiving hole so that the connecting rod serves as a retainer for retainer the female terminal in the prescribed insertion position.

2. The plug side connector assembly according to claim 1, wherein a plurality of pairs of the groove and the linear protrusion engaging each other between the adjacent two plug side housings are provided; and the grooves and the linear protrusions are located at selected positions on the corresponding side faces with respect to a direction orthogonal to a sliding direction along which each linear protrusion slides with respect to the corresponding groove so that only such two of the plug side housings that form joints at same positions with respect to the direction orthogonal to the sliding direction can be joined to each other.

3. The plug side connector assembly according to claim 1, wherein each groove is configured to be engaged by the corresponding linear protrusion by a dovetail joint so that the adjacent plug side housings are inseparably joined to each other in a lateral direction orthogonal to the side faces of the plug side housings.

4. The plug side connector assembly according to claim 3, wherein each side face is provided with a positioning groove extending from at least one end of the groove in a same direction as the groove and configured to be engaged by the corresponding linear protrusion in the lateral direction or a positioning protrusion extending from at least one end of the linear protrusion in a same direction as the linear protrusion and configured to be engaged by the corresponding groove in the lateral direction.

5. The plug side connector assembly according to claim 1, wherein each plug side housing is provided with an engagement portion configured to be detachably engaged by an engagement portion provided on a device side housing of a device side connector to prevent the plug side housing from being pulled out of the device side housing, an operation portion for disengaging the engagement portion of the plug side housing from the engagement portion of the device side housing, and a connecting portion for detachably connecting the operation portion with the operation portion of the adjacent plug side housing.

6. The plug side connector assembly according to claim 1, wherein the plug side housings are colored differently depending on kinds of the plug side housings.

7. A device side connector, comprising a device side housing defining a connector insertion chamber configured to detachably receive all of the plug side connectors forming the assembly according to claim 1, and device side terminals configured to be electrically connected to the corresponding plug side terminals when the plug side connectors are inserted into the connector insertion chamber.

8. A device side connector, comprising a device side housing defining a connector insertion chamber configured to detachably receive all of the plug side connectors forming the assembly according to claim 6, and device side terminals configured to be electrically connected to the corresponding plug side terminals when the plug side connectors are inserted into the connector insertion chamber, the device side housing being provided at positions thereof where the plug side housings of respective kinds are to be inserted with colored parts colored in the same colors as the respective plug side housings which are to be inserted in these positions.

9. The device side connector according to claim 7, wherein the device side housing is provided with a plurality of guide portions configured to guide the corresponding plug side connectors individually for each plug side housing as the plug side connectors are inserted into and pulled out of the device side housing.

10. A connector pair comprising a plurality of plug side connectors forming the assembly according to claim 1, and a device side connector comprising a device side housing defining a connector insertion chamber configured to detachably receive all of the plug side connectors forming the assembly and device side terminals configured to be electrically connected to the connector insertion chamber.

* * * * *